US008714794B2

(12) United States Patent
Yamazaki et al.

(10) Patent No.: US 8,714,794 B2
(45) Date of Patent: May 6, 2014

(54) VEHICLE LAMP

(75) Inventors: Tomoyasu Yamazaki, Tokyo (JP); Shimpei Masuda, Shizuoka (JP); Hisayoshi Shirasu, Shizuoka (JP)

(73) Assignees: Koito Manufacturing Co., Ltd., Tokyo (JP); Hino Motors Ltd., Tokyo (JP); Toyota Jidosha Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 13/612,364

(22) Filed: Sep. 12, 2012

(65) Prior Publication Data

US 2013/0063961 A1 Mar. 14, 2013

(30) Foreign Application Priority Data

Sep. 13, 2011 (JP) ..... 2011-199542

(51) Int. Cl.
*F21V 5/04* (2006.01)

(52) U.S. Cl.
USPC ..... 362/521; 362/522; 362/544

(58) Field of Classification Search
USPC ..... 362/516, 519, 521, 522, 540, 544
See application file for complete search history.

(56) References Cited

U.S. PATENT DOCUMENTS

| | | | | |
|---|---|---|---|---|
| 6,650,058 | B1 * | 11/2003 | Wang | 362/519 |
| 7,854,538 | B2 * | 12/2010 | Helms | 362/544 |
| 8,052,313 | B2 * | 11/2011 | Sassoon | 362/540 |
| 2006/0067086 | A1 * | 3/2006 | Hsu | 362/544 |

FOREIGN PATENT DOCUMENTS

JP 2006-82657 A 3/2006

* cited by examiner

*Primary Examiner* — David V Bruce
(74) *Attorney, Agent, or Firm* — Sughrue Mion, PLLC

(57) ABSTRACT

A vehicle lamp includes a first lamp having a first light emitting area, the first light emitting area having a circular shape or a roughly circular shape, a second lamp having a second light emitting area, the second light emitting area having a ring shape surrounding the first light emitting area, a lamp housing inside which the first lamp and the second lamp are provided, the lamp housing having an outer lens, the outer lens having first light distribution control steps in the first light emitting area, and an inner lens having second light distribution control steps in the second light emitting area.

6 Claims, 5 Drawing Sheets

VEHICLE LAMP

CROSS-REFERENCE TO RELATED APPLICATION

The present application claims priority from Japanese Patent Application No. 2011-199542 filed on Sep. 13, 2011, the entire content of which is incorporated herein by reference.

FIELD OF INVENTION

The present invention relates to a vehicle lamp, in particular, a combination lamp in which a plurality of different lamps are incorporated.

DESCRIPTION OF RELATED ART

Examples of combination lamps include a combination headlamp and a rear combination lamp. The combination headlamp may be configured to include a high beam lamp, a low beam lamp and a clearance lamp. The rear combination lamp may be configured to include a tail-and-stop lamp, a turn signal lamp and a back-up lamp. A related art vehicle lamp is a combination headlamp of a two-wheel vehicle, and includes a headlamp and a position lamp (see, e.g., JP 2006-082657 A). The position lamp is arranged to forwardly emit light from a region surrounding a periphery of the headlamp to indicate the presence of the vehicle even when the headlamp is being turned off. The position lamp may be turned on together with the headlamp, and to produce a desired light distribution by the light from the respective lamps, lens steps may be provided on an inner surface of a transparent cover of a lamp housing. The lens steps are, for example, lens elements or prism elements. To improve luminous effect of the position lamp, a light transmissive member having a light diffusing function is provided in front of the position lamp. The light diffusing function is provided by, for example, graining.

The light transmissive member is provided to diffuse the light of the position lamp, however, its contribution to a light distribution for irradiation in certain directions with a required luminous intensity distribution is small. Accordingly, in the case that the lens steps are provided on the inner surface of the transparent cover to produce the light distribution by the light from the respective lamps, the light distribution is produced substantially by the refraction of the light at the lens steps on the transparent cover. With this configuration, when the combination headlamp is observed from the front, for both the headlamp and the position lamp, a light refracting portion of the transparent cover appears as a luminous surface, i.e., a light emitting surface. In other words, the portion of the transparent cover where the lens steps are provided is recognized as a light emitting surface. As a result, the light emitting surfaces of the headlamp and the position lamp both appear as being on the same surface, i.e., the surface of the transparent cover. Therefore, in the case that the headlamp and the position lamp are disposed adjacent to each other, it is difficult to clearly distinguish the light emitting areas of the headlamp and the position lamp. Further, because the light emitting surfaces of the respective lamps look planar, it does not give a sense of depth, and the external appearance quality may not be satisfactory.

BRIEF SUMMARY

Illustrative aspects of the present invention provide a vehicle lamp having a plurality of different lamps incorporated therein and, when they are turned on, providing an improved distinguish ability of the lamps an improved external appearance.

According to an illustrative aspect of the present invention, a vehicle lamp includes a first lamp having a first light emitting area, the first light emitting area having a circular shape or a roughly circular shape, a second lamp having a second light emitting area, the second light emitting area having a ring shape surrounding the first light emitting area, a lamp housing inside which the first lamp and the second lamp are provided, the lamp housing having an outer lens, the outer lens having first light distribution control steps in the first light emitting area, and an inner lens having second light distribution control steps in the second light emitting area.

Other aspects and advantages of the invention will be apparent from the following description, the drawings and the claims.

DETAILED DESCRIPTION

Hereinafter, an exemplary embodiment of the present invention will be described in detail with reference to the drawings. However, the following exemplary embodiment does not limit the scope of the claimed invention.

Figure 1:
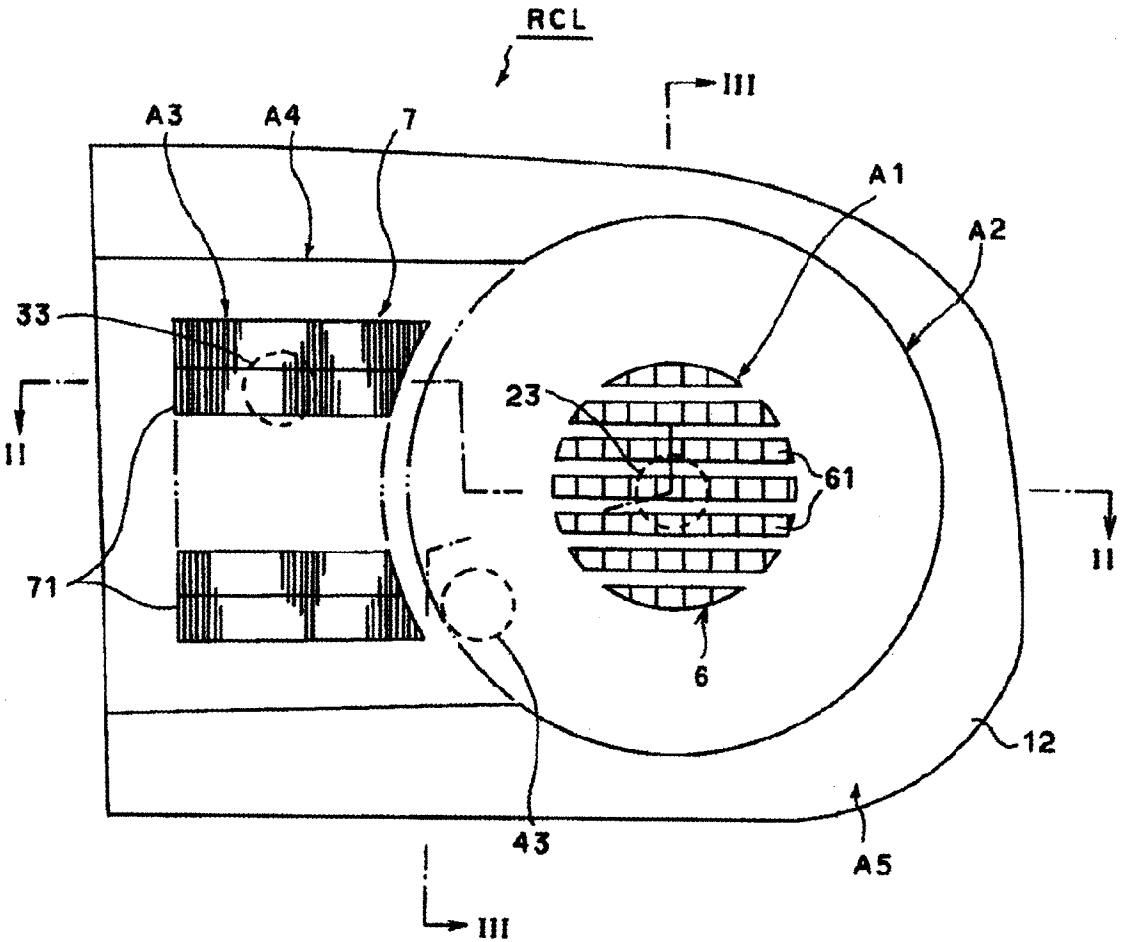
FIG. 1 is a front view of a vehicle lamp according to an exemplary embodiment of the present invention.

FIG. 1 is a front view of a rear combination lamp RCL (an example of a vehicle lamp) adapted to be mounted on a right side of a rear portion of an automobile. A front surface (an outer surface) of an outer lens 12 of the rear combination lamp RCL is zoned into areas A1 to A5. A circular region relatively closer to a laterally outer side (a right side) of a vehicle is zoned as a turn signal light emitting area A1, and an annular region along the outer periphery of the turn signal light emitting area A1 is zoned as a tail-and-stop light emitting area A2. Further, a substantially rectangular region next to a laterally inner side (a left side) of the tail-and-stop light emitting area A2 is zoned as a back-up light emitting area A3. These light emitting areas A1 to A3 are surrounded by dummy light emitting areas A4 and A5.

Figure 2:
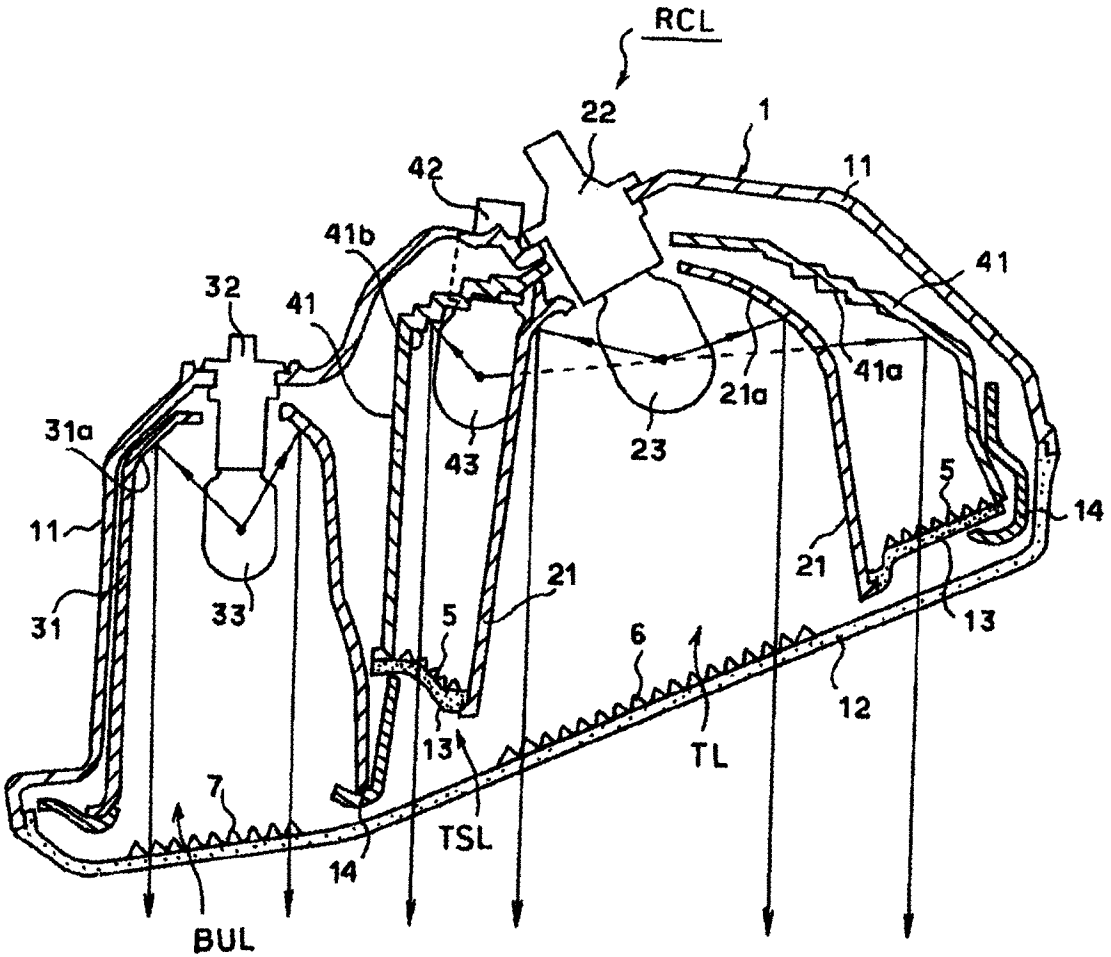
FIG. 2 is a cross-sectional view taken along line II-II in FIG. 1.
Figure 3:
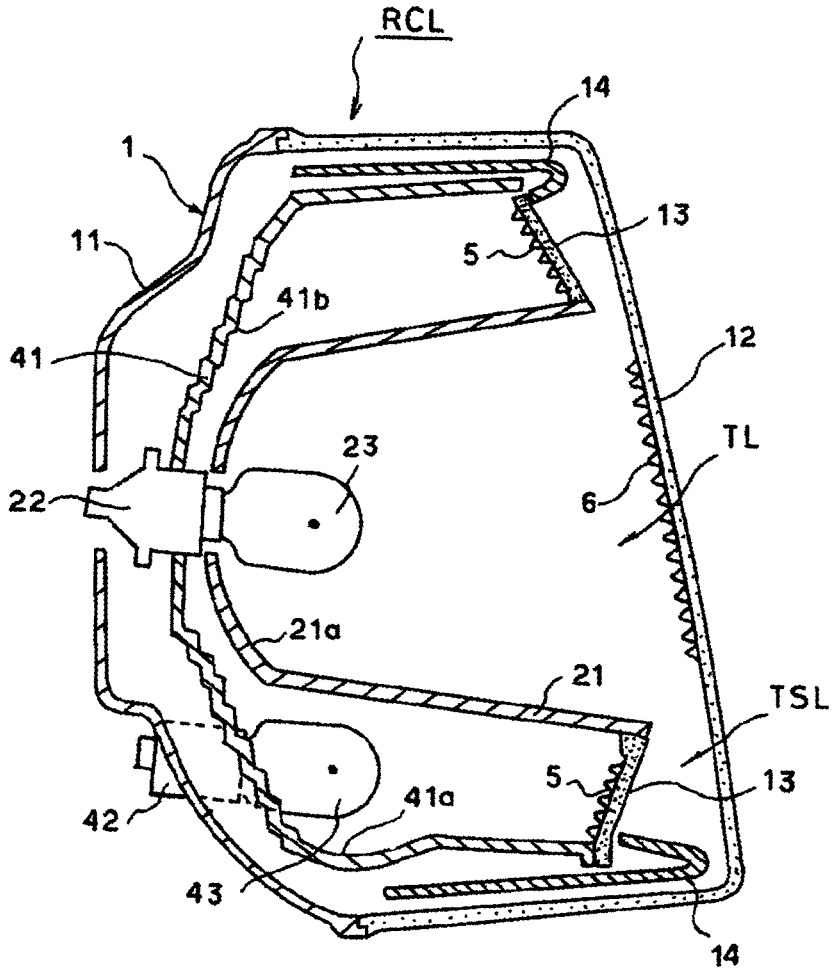
FIG. 3 is a cross-sectional view taken along line in FIG. 1.
Figure 4:
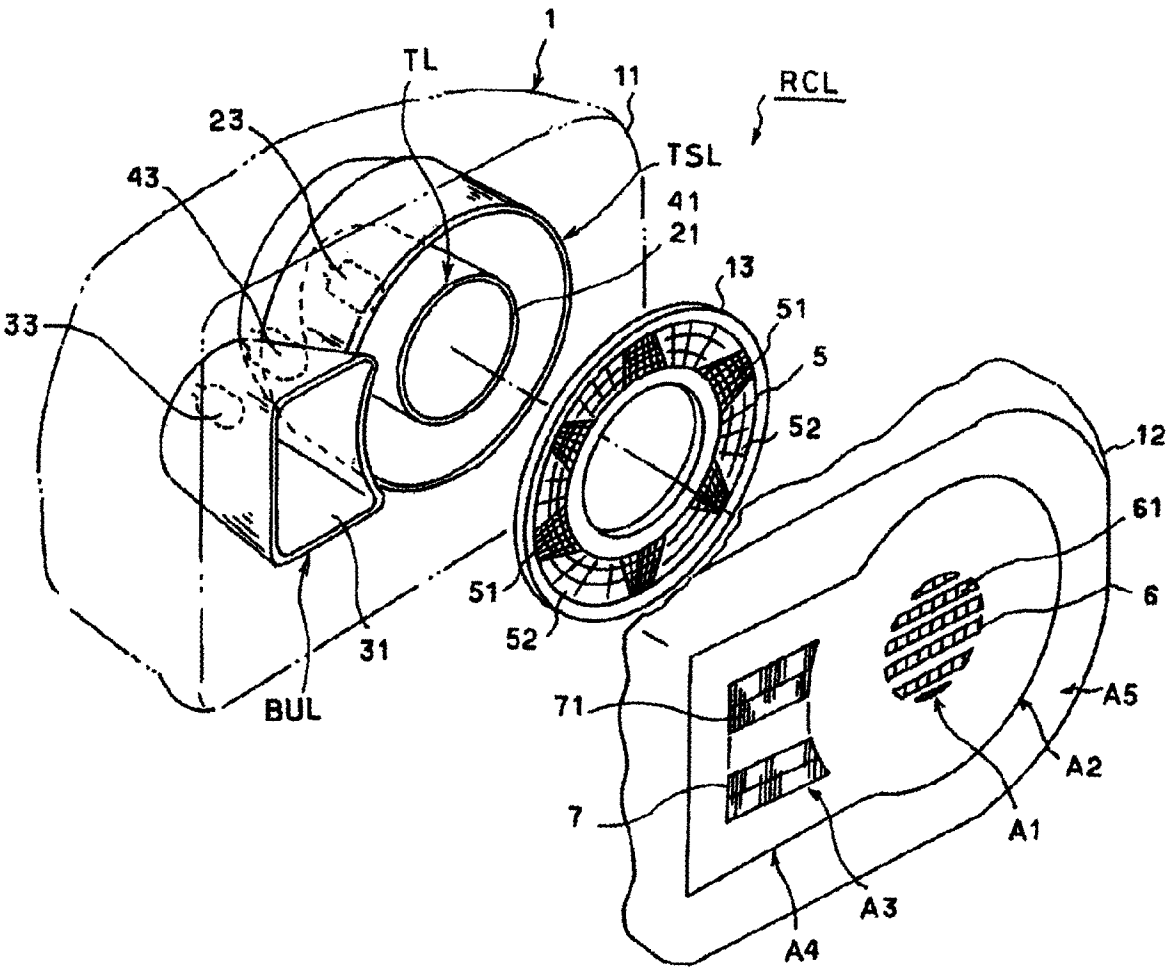
FIG. 4 is a perspective view of the vehicle lamp, illustrating an outer lens and an inner lens of the vehicle lamp in a separated manner and in which an extension is omitted.

As shown in FIGS. 2 to 4 the rear combination lamp RCL includes a container-shaped lamp body 11 having a front opening, and the outer lens 12 is attached to the front opening of the lamp body 11 to form a lamp housing 1. As described above, the outer lens 12 zoned into the turn signal light emitting area A1 the tail-and-stop light emitting area A2, and the back-up light emitting area A3. The area A4 has a substantially C-shape surrounding the back-up light emitting area A3, and is formed as a colorless transparent portion. The area A5 outside the areas A1 to A4 is formed as a red transparent portion. The outer lens 12 is formed as a one-piece multiplex lens.

A turn signal lamp TL, a back-up lamp BUL, and a tail-and-stop lamp TSL are integrally installed inside the lamp housing 1 to form the rear combination lamp RCL. The turn signal lamp TL is arranged at a location facing the turn signal light emitting area A1, and the back-up lamp BUL is arranged at a location facing the back-up light emitting area A3. The tail-and-stop lamp TSL is at a location facing the tail-and-stop light emitting area A2. In addition, an extension 14 is arranged in a boundary region between the tail-and-stop lamp TSL and the back-up lamp BUL and in a region facing the areas A4 and A5 of the outer lens 12, so that the respective lamps and the light emitting areas are optically separated by preventing light leakage between one another.

The turn signal lamp TL (an example of a first lamp) includes a reflector 21 having a circular front opening corresponding to the turn signal light emitting area A1, and a light source 23, a light bulb in this example, disposed inside the reflector 21 and mounted on a socket 22 supported by the lamp body 11. The reflector 21 has an effective reflecting portion 21*a* formed as a paraboloidal or an approximately paraboloidal curved surface. The reflector 21 is configured such that, when the light bulb 23 is turned on, light emitted by the light bulb 23 is reflected by the effective reflecting portion 21*a* to form an approximately parallel light beam directed toward the front of the lamp through the front opening. The light bulb 23 is configured as an umber light bulb to emit umber light.

The back-up lamp BUL includes a reflector 31 having a substantially rectangular front opening corresponding to the back-up light emitting area A3, and a light source 33, a light bulb in this example, disposed inside the reflector 31 and mounted on a socket 32 supported by the lamp body 11. Like the turn signal lamp TL, the reflector 31 of the back-up lamp BUL has an effective reflecting portion 31*a* formed as a paraboloidal or an approximately paraboloidal curved surface. The reflector is configured such that, when the light bulb 33 is turned on, light emitted by the light bulb 33 is reflected by he effective reflecting portion 31*a* to form an approximately parallel light beam directed toward the from of the lamp through the front opening. The light bulb 33 is configured as a white light bulb to emit white light.

The tail-and-stop lamp TSL (an example of a second lamp) includes a reflector 41 having a circular front opening along the outer periphery of the annular tail-and-stop light emitting area A2, and a light source 43, a light bulb in this example, disposed inside the reflector 41 and mounted on a socket 42 supported by the lamp body 11. The reflector 41 is arranged to surround the outer periphery of the reflector 21 of the turn signal lamp TL, and forms an annular front opening corresponding to the tail-and-stop light emitting area A2, outside the front opening of the reflector 21. The light bulb 43 is configured as a white light bulb. The light bulb 43 is disposed in a region facing the annular front opening of the reflector 41. More specifically, the light bulb 32 is arranged at a location obliquely downward from the reflector 21. The reflector 41 has an effective reflecting portion 41. The effective reflecting portion 41 has a plurality of reflective segments 41*b* circumferentially arranged in a region near the bulb 43. The reflector 41 is configured such that, when the light bulb 43 is turned on, light emitted by the light bulb 43 is reflected by the reflective segments 41*b* toward the entire circumferential region inside the reflector 41 so that the light is reflected by the entire effective reflecting portion 41*a* toward the front of the lamp through the annular front opening.

Figure 5:
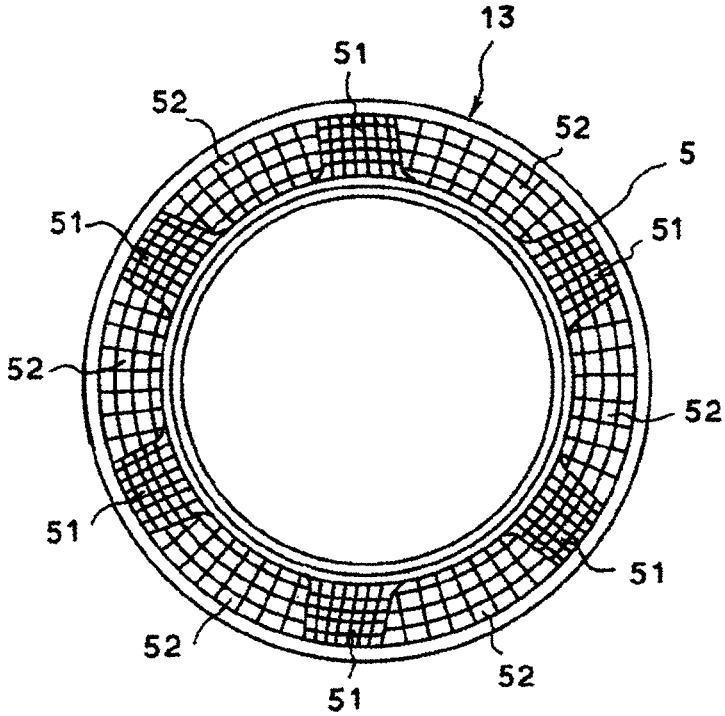
FIG. 5 is a front view of the inner lens.

In front of the annular front opening of the reflector 41, an annular inner lens 13 is provided to cover the annular front opening. The inner lens 13 is a red transparent member, and is supported by the reflectors 21 and 41. Light distribution control steps 5 (an example of second light distribution control steps) are formed on the inner surface of the inner lens 13. The light distribution control steps 5 are configured to produce a required light distribution by the light emitted by the bulb 43 and reflected by the reflector 41 to pass through the inner lens 13. FIG. 5 is a front view of the inner lens 13. The light distribution control steps 5 include a plurality of radial stepped portions 51 and a plurality of insular stepped portions 52. The radial stepped portions 51 and the insular stepped portions 52 are arranged alternately in the circumferential direction. The radial stepped portions 52 are arranged in regions extending in six radial directions from the virtual center of the inner lens 13, and in each of the radial stepped portions 52, rectangular lens steps, each having relatively short sides, are arranged in a grid pattern. The insular stepped portions 52 are arranged in six regions isolated by the radial stepped portions 52, and in each of the insular stepped portions 52, rectangular lens steps, each having relatively long sides, are arranged in a grid pattern. To produce a desired light distribution, the lens steps of the radial stepped portions 51 and the lens steps of the insular stepped portions 52 are configured, for example, such that wedge-shaped cross sections of the lens steps in the thickness direction of the lens are oriented in different directions, so that light rays passing through the respective lens steps are refracted in different directions.

The outer lens 12, on the other hand has light distribution control steps 6 (an example of first light distribution control steps) in the turn signal light emitting area A1 and light distribution control steps 7 in the back-up light emitting area A3. Light distribution control steps are not formed in other areas of the outer lens 12. That is, the other areas of the outer lens have a non-stepped structure so that the light can simply pass through these areas. Configurations of the light distribution control steps 6 in the turn signal light emitting area A1 and the light distribution control steps 7 in the back-up light emitting area A3 are optional, in so far as their desired light distribution patterns are produced. In this exemplary embodiment, the light distribution control steps 6 are grid patterned lens steps, each having relatively long side, arranged in a plurality of horizontal rows 61 within the turn signal light emitting area A1. To produce a desired light distribution, the lens steps is configured, for example, such that a cross-sectional shape of each of the lens step in the thickness direction of the lens has a fine spherical or cylindrical shape, so that light rays passing through the respective lens steps are refracted in required directions. The light distribution control steps 7 in the back-up light emitting area A3 arranged in two horizontal rows 71, each having a wavy or serrated horizontal cross-sectional shape to produce a desired light distribution by light rays passing through the respective rows of lens steps 71.

According to the rear combination lamp RCL of the exemplary embodiment having the configuration described above, when the light bulb 23 of the turn signal lamp TL is turned on, the emitted umber light is reflected by the effective reflecting portion 21*a* of the reflector 21 toward the front opening of the reflector 21 to enter the turn signal light emitting area A1 of the outer lens 12. The light is refracted by the light distribution control steps 6 when passing through the turn signal light emitting area A1 of the outer lens 12, whereby a required light distribution is produced. Accordingly, when the turn signal lamp TL is turned on, a portion of the surface of the outer lens 12, where the light distribution control steps 6 refracts the light, provides an external appearance of the light emitting area A1 of the turn signal lamp TL.

Likewise, when the light bulb 33 of the back-up lamp BUL is turned on, the emitted white light is reflected by the effective reflecting portion 31*a* of the reflector 31 toward the front opening of the reflector 31 to enter the back-up light emitting area A3 of the outer lens 12. The light is refracted by the light distribution control steps 7 when passing through the back-up light emitting area A3 of the outer lens 12, whereby a required light distribution is produced. Accordingly, when the back-up lamp BUL is turned on, a portion on the surface of the outer lens 12, where the light distribution control steps 7 refracts the light, provides an external appearance of the light emitting area A3 of the back-up lamp BUL.

On the other hand, when the light bulb 43 of the tail-and-stop lamp TSL is turned on, the emitted red light is reflected circumferentially and toward the front opening of the reflector 41 by the effective reflecting portion 41*a* of the reflector 41 to enter the inner lens 13 provided at the front opening. The light is refracted by the light distribution control steps 5 when passing through the inner lens 13, and then passes through the annular tail-and-stop light emitting area A2 of the outer lens 12 with a required light distribution. Accordingly, when the tail-and-stop lamp TSL is turned on, a portion on the surface of the inner lens 13, where the light distribution control steps 5 refracts the light, provides an external appearance of the light emitting area A2 of the tail-and-stop lamp TSL.

Figure 6:
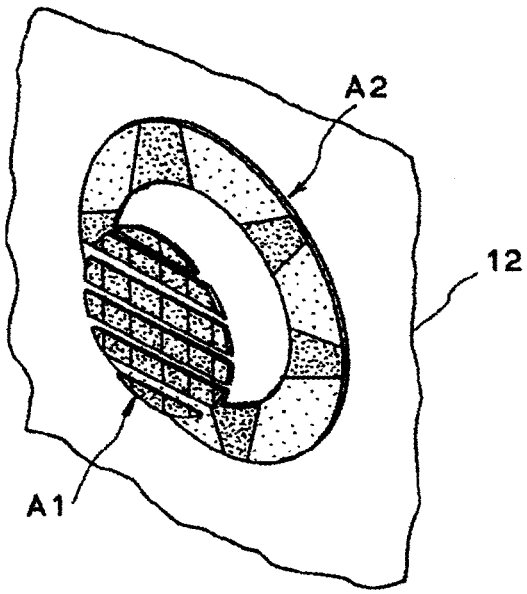
FIG. 6 is a conceptual diagram illustrating the appearance of light emission.

That is, when the turn signal lamp TL and the back-up lamp BUL are turned on, the light emitting areas on the surface of the outer lens 12 where the light distribution control steps 6 and the light distribution control steps 7 are formed defines external appearances of the light emitting areas A1 and A3 of the respective lamps. Further, when the tail-and-stop lamp TSL turned on, the light emitting area on the surface of the inner lens 13 where the light distribution control steps 5 are formed defines an external appearance of the light emitting area A2 of the tail-and-stop lamp TSL. Accordingly, when the turn signal lamp TL having the circular light emitting area A1 and the tail-and-stop lamp TSL having the annular light emitting area A2 outside the circular light emitting area A1 are turned on, the red annular tail-and-stop light emitting area A2 is observed around the umber circular turn signal light emitting area A1 and at a deeper position than the turn signal light emitting area A1. That is, the turn signal light emitting area A1 and the tail-and-stop light emitting area A2 appear three dimensionally. For example, when the lamp is observed obliquely from the front, as conceptually shown in FIG. 6, the light emitting areas A1, A2 are visually recognized as being three dimensionally superimposed. Accordingly, the light emission of the lamps TL, TSL are clearly distinguished, and an external appearance with an improved design is provided.

Moreover, in the exemplary embodiment, the light distribution control steps 6 (an example of first light distribution control steps) of the outer lens 12 for the turn signal lamp TL are configured as grid patterned lens steps, and the radial stepped portions 51 (an example of second light distribution control steps) are provided as the light distribution control steps 5 of the inner lens 13 for the tail-and-stop lamp TSL. Accordingly, the refraction of light in the turn signal light emitting area A1 and the refraction of light in the tail-and-stop light emitting area A2 are different. For example, the grid patterned lens steps 61 creates emission lines appearing between the respective lens steps in a grid manner, and radial stepped portions 51 creates emission lines appearing in a radial manner. Accordingly, these emission lines are clearly distinguishable. Consequently, it is possible to clearly distinguish the light emissions of the lamps TL, TSL, and to further improve a design aspect of the external appearance.

In addition, in the exemplary embodiment, the light distribution control steps 5 (an example of second light distribution control steps) on the inner lens 13 include the radial stepped portions 51 and the insular stepped portions 52, and a size of the lens steps of the radial stepped portions 51 and a size of the lens steps of the insular stepped portions 52 are different from each other, one has the les steps of small sides and the other has the lens steps of large sides. Therefore, when light is refracted in the inner lens 13, the lengths and pitches of the emission lines between the steps are observed in the respective stepped portions 51, 52 are different from each other. Accordingly, the external appearance of the light emitting area A2 of the tail-and-stop lamp TSL becomes more attractive, and a design aspect of the external appearance is further improved. Further, it is possible to arbitrarily design an appearance effect and to adjust the amount of light of each of the lens steps in light distribution control by appropriately adjusting the dimensions of the lens step forming each of the stepped portions 51 and 52.

In the exemplary embodiment, a combination of a turn signal lamp and a tail-and-stop lamp is described as an example of first and second lamps. However, the present invention is applicable to other optional combinations of lamps. Further, the light emitting area of the first lamp, e.g., the turn signal lamp of the exemplary embodiment, is not limited to a circular shape, and may be a rectangular or polygonal shape resembling a circular shape. Also, the light emitting area of the second lamp, e.g., the tail-and-stop lamp, is not limited to an annular shape, and may be a rectangular ring shape or a polygonal ring shape resembling an annular shape so as to correspond to the shape of the light emitting area of the first lamp.

The light distribution control lens steps of the outer lens and the inner lens are not limited to those of the exemplary embodiment described above, and may be configured to have other structures in accordance with a required light distribution. Further, the present invention is applicable not only to a rear combination lamp but also to other combination lamps in which a plurality of different lamps are incorporated.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

What is claimed is:

1. A vehicle lamp comprising:

a first lamp having a first light emitting area, the first light emitting area having a circular shape or a roughly circular shape;

a second lamp having a second light emitting area, the second light emitting area having a ring shape surrounding the first light emitting area;

a lamp housing inside which the first lamp and the second lamp are provided, the lamp housing comprising an outer lens, the outer lens comprising first light distribution control steps in the first light emitting area; and an inner lens comprising second light distribution control steps in the second light emitting area.

2. The vehicle lamp according to claim 1, wherein the first light distribution control steps comprise grid patterned lens steps arranged in a grid manner, and wherein the second light distribution control steps comprise radial lens steps arranged in a radial manner.

3. The vehicle lamp according to claim 1, wherein the second light distribution control steps comprise a stepped portion having small lens steps and another stepped portion having large lens steps, wherein a size of each of the large lens steps is larger than a size of each of the small lens steps.

4. The vehicle lamp according to claim 2, wherein the second light distribution control steps further comprises large lens steps, wherein a size of each of the large lens steps is larger than a size of each of the radial lens steps.

5. The vehicle lamp according to claim 2, wherein the second light distribution steps further comprise insular lens steps arranged in one or more regions being isolated by the radial lens steps.

6. The vehicle lamp according to claim 1, wherein the inner lens is provided between the outer lens and the second lamp.

* * * * *